US006079997A

United States Patent [19]

Lu

[11] Patent Number: 6,079,997

[45] Date of Patent: Jun. 27, 2000

[54] LAMP SOCKET WITH RAINWATER DRAINAGE MEANS

[76] Inventor: Chong-Ying Lu, 12F-1, No. 311, Sec. 4, Chung Hsiao E. Road, Taipei, Taiwan

[21] Appl. No.: 09/135,429

[22] Filed: Aug. 17, 1998

[51] Int. Cl.[7] ..... H01R 4/60

[52] U.S. Cl. ..... 439/206; 439/666

[58] Field of Search ..... 439/206, 666, 439/667

[56] References Cited

U.S. PATENT DOCUMENTS 5,350,315 9/1994 Cheng ..... 439/666

5,385,485 1/1995 Fu ..... 439/667

*Primary Examiner*—Neil Abrams

*Assistant Examiner*—Javaid Nasri

*Attorney, Agent, or Firm*—Rosenberg, Klein & Lee

[57] ABSTRACT

A lamp socket includes a double open end, conical socket shell, a socket cap covered on one open end of the conical socket shell and having a plurality of through holes, a metal contact ring fastened to two mounting tabs inside the conical socket shell for receiving the ring contact of a bulb, and a metal contact plate fastened to a transverse frame within the bottom open end of the conical socket shell for the contact of the tip contact of the bulb being threaded into the metal socket ring, the conical socket shell and the metal contact ring defining a water passage therebetween in communication with the through holes on the socket cap for guiding rain water out of the lamp socket.

2 Claims, 4 Drawing Sheets

LAMP SOCKET WITH RAINWATER DRAINAGE MEANS

BACKGROUND OF THE INVENTION

The present invention relates to lamp sockets, and more particularly to such a lamp socket which has drainage means to guide out rain water and to prevent an accumulation of rain water.

When lamp sockets are used outdoors, rainwater may pass to the inside of the lamp sockets, causing a short circuit. In order to stop rain water from passing to the inside of a lamp socket, the precision of the parts must be critically designed, and rubber water sealing means may be used to seal gaps between parts. The critical precision requirement and the installation of rubber water sealing means greatly increases the cost of the lamp socket. Furthermore, the rubber water sealing means wear quickly with use under the weather.

SUMMARY OF THE INVENTION

The present invention has been accomplished under the circumstances in view. It is one object of the present invention to provide a lamp socket which prevents an accumulation of rain water. It is another object of the present invention to provide a lamp socket which has a simple structure, and is inexpensive to manufacture. According to the present invention, the lamp socket is comprised of a double open end conical socket shell, a metal contact ring suspended inside the conical socket shell for receiving the ring contact of a bulb, a metal contact plate suspended in the conical socket shell for the contact of the tip contact of the bulb installed in the metal contact ring, and a socket cap covered on one end of the conical socket shell. The socket cap has a plurality of through holes through which electric wires are inserted and connected to the metal contact plate and the metal contact ring. A water passage is defined within the conical socket shell around the metal contact ring in communication with the through holes on the socket cap for guiding rain water out of the lamp socket.

DETAILED DESCRIPTION OF THE PREFERRED EMBODIMENT

Figure 1:
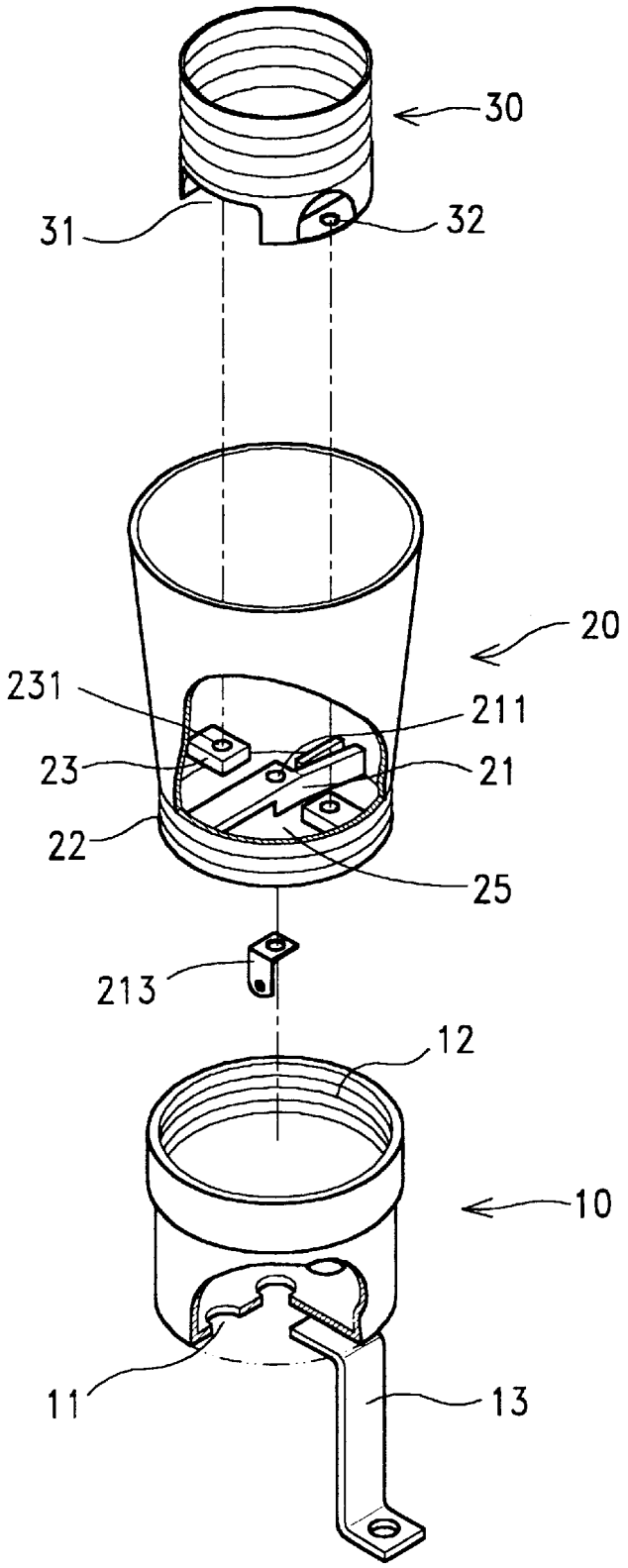
FIG. 1 is an exploded view of a lamp socket according to the present invention.
Figure 2:
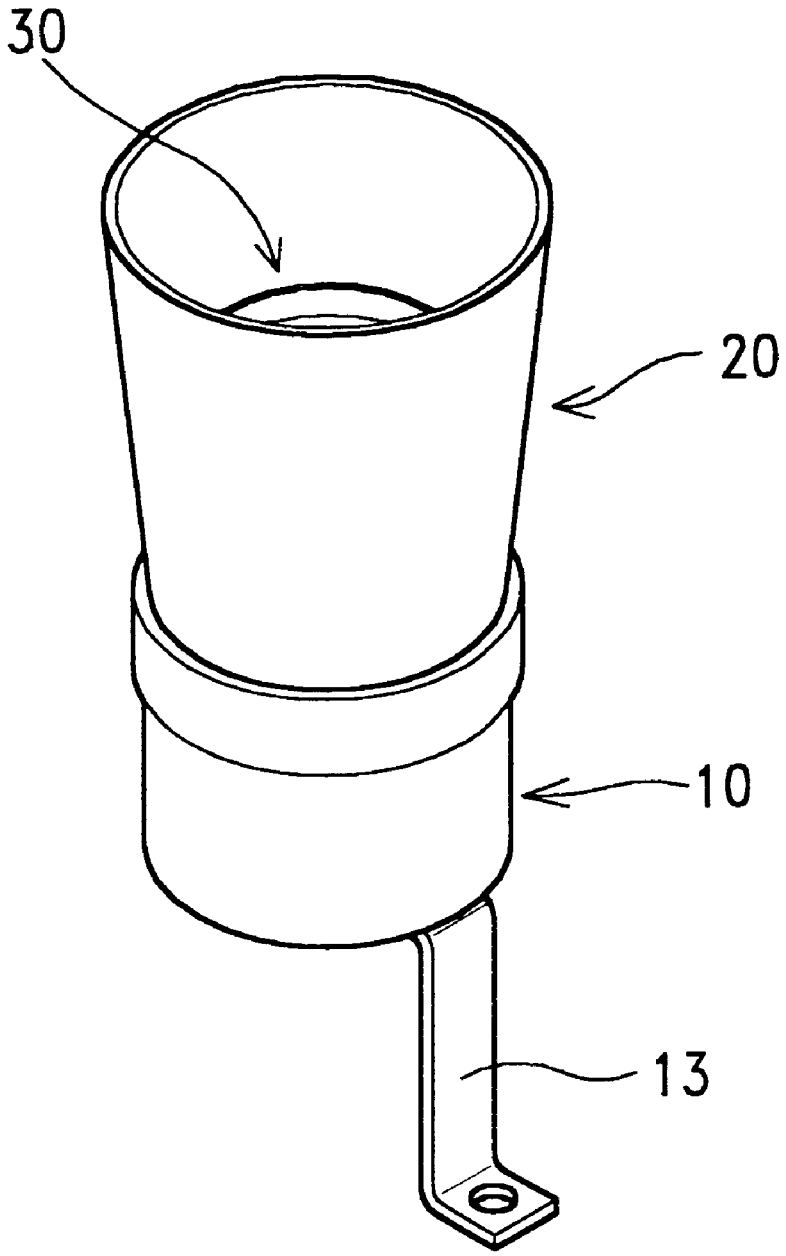
FIG. 2 illustrates the outer appearance of the lamp socket according to the present invention.

Referring to FIGS. 1 and 2, a lamp socket in accordance with the present invention is generally comprised of a socket cap 10, a conical socket shell 20, a metal contact ring 30, and a L-shaped metal contact plate 213.

Figure 3:
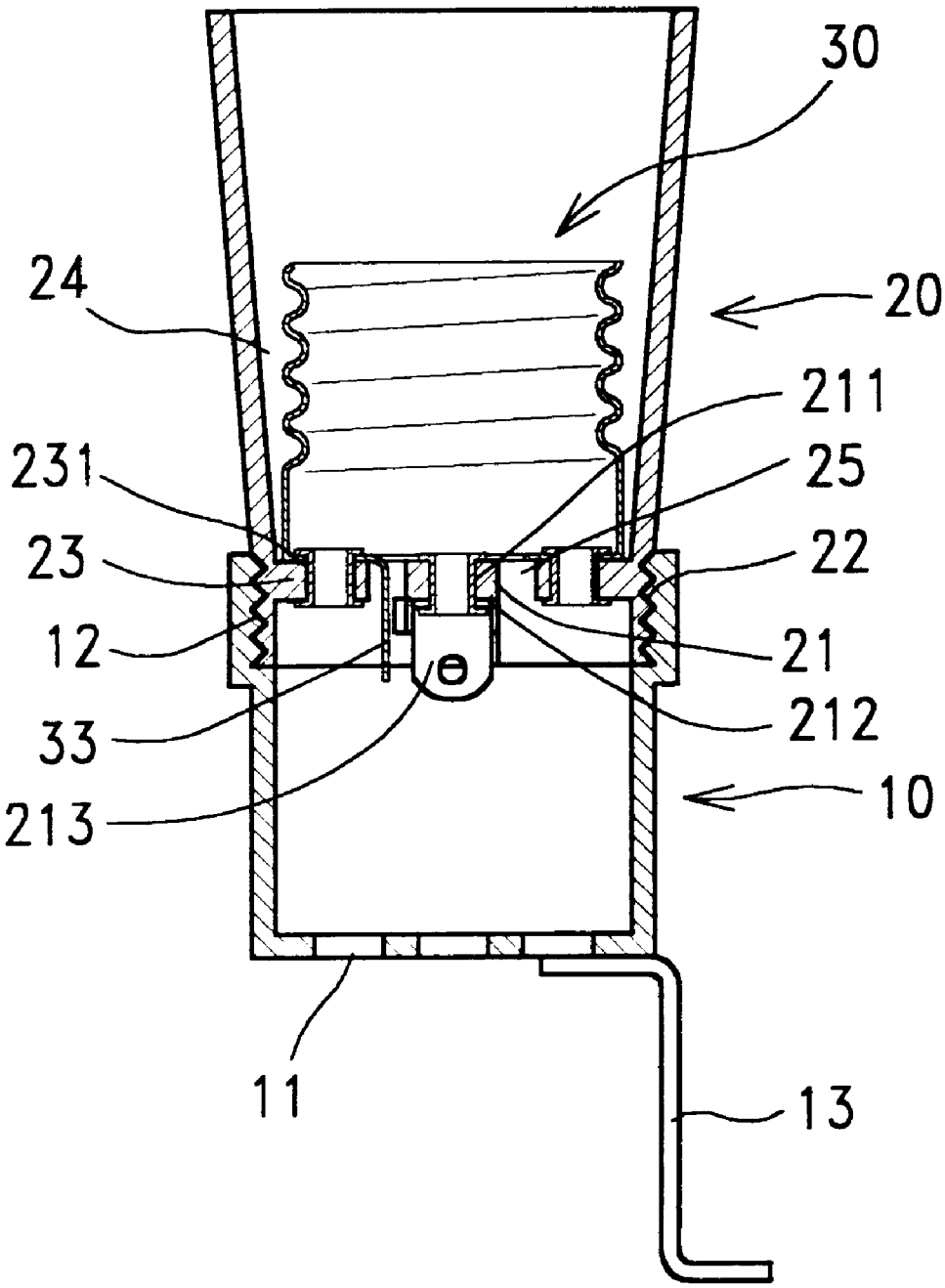
FIG. 3 is a sectional assembly view of the lamp socket according to the present invention.

Referring to FIG. 3 and FIGS. 1 and 2 again, the socket cap 10 has a plurality of through holes 11 at the bottom wall thereof, a L-shaped mounting rod 13 extended from the bottom wall for mounting, and an inner thread 12 at the opened top side thereof. The conical socket shell 20 has a smaller bottom end and a bigger top end, both the bottom end and the top end being opened, an outer thread 22 made around the periphery of the bottom end and threaded into the inner thread 12 on the socket cap 10, two mounting tabs 23 bilaterally disposed inside the bottom end, each mounting tab 23 having a mounting hole 231, and a transverse frame 21 equally spaced between the mounting tabs 23, the transverse frame 21 having a through hole 211 at the center. The metal contact ring 30 is an internally spirally threaded metal contact member mounted inside the conical socket shell 20 for receiving the ring contact of a bulb, having a bottom notch 31 which receives the transverse frame 21 of the conical socket shell 20, two bottom mounting holes 32 respectively fastened to the mounting holes 231 on the mounting tabs 23 inside the conical socket shell 20 by a respective rivet, and a bottom extension strip 33 extended out of the bottom opening 25 of the conical socket shell 20 into the inside space of the socket cap 10. The metal contact plate 213 is fixedly fastened to the through hole 211 on the transverse frame 21 at the bottom side by a metal rivet.

Figure 4:
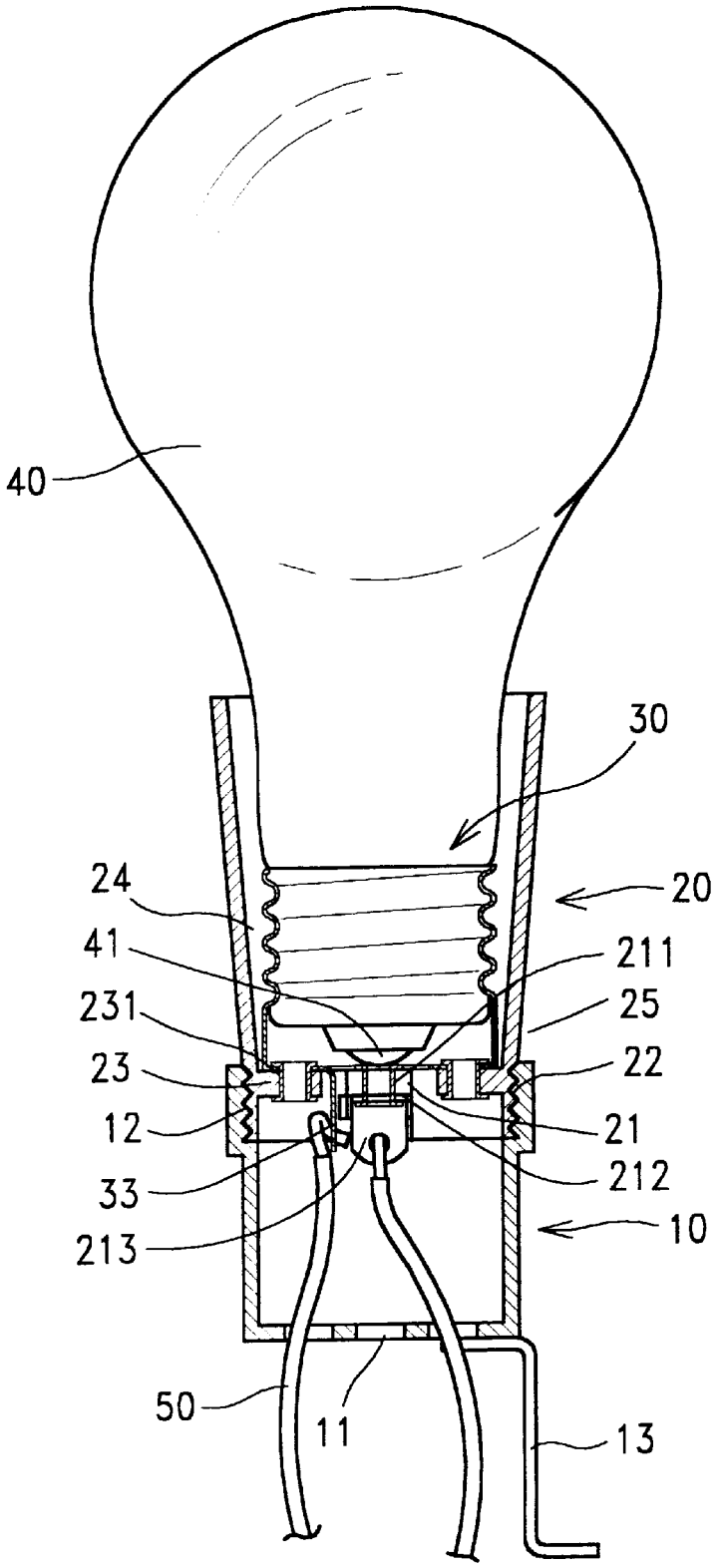
FIG. 4 is a sectional view of the present invention, showing electric wires respective inserted through the through holes on the socket cap and connected to the metal plate and the extension strip of the metal contact ring and the bulb installed.

Referring to FIG. 4, electric wires 50 are inserted through the through holes 11 on the socket cap 10, and respectively connected to the bottom extension strip 33 of the metal contact ring 30 and the L-shaped metal contact plate 213. When the ring contact of a bulb 40 is threaded into the metal contact ring 30, the tip contact 41 of the bulb 40 is retained in contact with the metal rivet at the metal contact plate 213. When the lamp socket is installed outdoors, rainwater is quickly guided out of the lamp socket through the space within the conical socket shell 20 around the metal contact ring 30 and the bottom opening 25 of the conical socket shell 20 and the through holes 11. Therefore, either the lamp socket is retained in an upwardly extended vertical position or a downwardly extended vertical position, rain water shall never be accumulated in the lamp socket.

While only one embodiment of the present invention has been shown and described, it will be understood that various modifications and changes could be made thereunto without departing from the spirit and scope of the invention disclosed.

What the invention claimed is:

1. A lamp socket comprising:

a conical socket shell having a small bottom open end, a big top open end, an outer thread around the periphery of said small bottom open end, two mounting tabs bilaterally disposed inside said small bottom open end, and a transverse frame equally spaced between said mounting tabs, said transverse frame having a through hole at the center;

a metal contact ring mounted inside said conical socket shell to receive the ring contact of a bulb and defining with said conical socket a water passageway around the periphery thereof within said conical socket shell in communication with wire holes on a socket cap, said metal contact ring comprising a bottom notch, which receives the transverse frame of said conical socket shell, two bottom mounting holes respectively fastened to the mounting tabs of said conical socket shell by a respective rivet, and a bottom extension strip extended out of the small bottom open end of said conical socket shell;

a metal contact plate fixedly fastened to the through hole on said transverse frame of said conical socket shell at a bottom side for electric contact with the tip contact of the bulb threaded into said metal contact ring; and the socket cap covered on the small bottom open end of said conical socket shell, said socket cap comprising an inner thread threaded onto the outer thread of said conical socket shell, and the plurality of through holes at a bottom side wall thereof through which two electric wires are inserted and respectively connected to said metal contact plate and the extension strip of said metal contact ring.

2. The lamp socket of claim 1 wherein said socket cap comprises a L-shaped mounting rod extended from the bottom side wall thereof on the outside for mounting.

* * * * *